US005752874A

United States Patent [19]

Meyer, Jr. et al.

[11] Patent Number: 5,752,874

[45] Date of Patent: May 19, 1998

[54] MEANS AND METHOD FOR FABRICATION OF GRAZING INCIDENCE OPTICS

[75] Inventors: George W. Meyer, Jr., Ridgefield; Steven S. Chuang, Newtown, both of Conn.

[73] Assignee: Hughes Aircraft Company, Los Angeles, Calif.

[21] Appl. No.: 375,057

[22] Filed: Jan. 19, 1995

Related U.S. Application Data

[63] Continuation of Ser. No. 975,172, Nov. 12, 1992, abandoned.

[51] Int. Cl.[6] ..... B24B 11/00

[52] U.S. Cl. ..... 451/28; 451/178; 451/388; 451/541; 451/548

[58] Field of Search ..... 451/178, 212, 451/213, 214, 215, 216, 229, 224, 225, 230, 541, 548, 28, 41, 42, 388

[56] References Cited

U.S. PATENT DOCUMENTS

| | | | |
|---|---|---|---|
| 1,399,400 | 12/1921 | Pellow | 51/284 |
| 1,749,982 | 3/1930 | Nesbitt | 51/206 R |
| 3,154,894 | 11/1964 | Dawkins | 51/206 R |
| 3,574,977 | 4/1971 | Spragg | 51/284 |
| 3,667,166 | 6/1972 | White | 51/92 R |
| 4,958,463 | 9/1990 | Hess | 51/91 R |

FOREIGN PATENT DOCUMENTS

| | | | |
|---|---|---|---|
| 0688325 | 10/1979 | U.S.S.R. | 51/206 R |

*Primary Examiner*—Jack W. Lavinder

*Attorney, Agent, or Firm*—W. C. Schubert; W. K. Denson-Low

[57] ABSTRACT

A grazing incidence optic is fabricated by grinding, polishing, or both, using a tapered, barrel-shaped tool. The optic surface to be ground or polished is placed in contact with a selected portion of the grinding or polishing surface of the tool, and the tool is rotated about its longitudinal axis. The optic is subjected to a reciprocating grinding movement along the length of the barrel tool. A helical groove in the tool allows slurry to pass between the optic surface being worked and the tool surface. Air is forced between the optic surface and the tool surface to release the optic from the tool.

13 Claims, 4 Drawing Sheets

MEANS AND METHOD FOR FABRICATION OF GRAZING INCIDENCE OPTICS

This is a continuation application Ser. No. 07/975,172, filed Nov. 12, 1992 now abandoned.

BACKGROUND OF THE INVENTION

This invention relates to grazing incidence optics and, more particularly, to the fabrication thereof.

The current technique used to shape grazing incidence optics is step grinding and polishing. The step grinding and polishing technique is specific for aspheric optics where the angle normal to the conic section about the axis of revolution is less than 70 °. The step grinding technique, when applied to grazing incidence optics, leaves high spatial frequency residual surface error that will degrade optical performance.

SUMMARY OF THE INVENTION

An object of the present invention is to provide shaping means and methods for fabricating grazing incidence optics.

An apparatus, according to the present invention, for fabricating a grazing incidence optic comprises a barrel-shaped tool having a working surface and a longitudinal axis of rotation; first mounting means for allowing the tool to rotate on about its longitudinal axis of rotation; and second mounting means for mounting the optical further comprises rotation means for rotating the tool about its longitudinal axis; and reciprocating means for causing the second mounting means to move in a reciprocating motion in the direction parallel to the longitudinal axis of rotation of the tool, whereby the optical component is reciprocating along a selected length of the working surface of the tool.

In still further accord with an apparatus according to the present invention, the tapered, barrel-shaped tool has a helical groove in the surface thereof.

Using such means and methods, one may select a tool stroke direction and pressure to achieve both high removal rate and accurate shape.

The present invention enables the achievement of very accurate surface shapes for grazing incidence optics, i.e., grazing incidence aspheres with large departures from best-fit spheres and cones. It also enables rapid shaping of the optic due to continuous contact between the optic and the precision-shaped tool. The invention is also usable for polishing, which needs to meet the same criteria as shaping, with the additional requirement of tool compliance. Such polishing corrects for residual surface defects left behind by a loose abrasive grinding process.

Since the tool has continuous contact with the optic workpiece, as opposed to the prior art reciprocating tool, multiple-pass approach, non-uniformities in shaping are eliminated. In other words, errors in forming the shape of the optic experienced using the reciprocating approach are obviated.

In addition, better utilization of tool contact area gives a faster material removal rate and more uniform removal than previous approaches. This is achieved by using a tool which has an effective contact area much larger than the area of the optical surface being worked.

The present invention applies to grazing incidence optics, including aspheres, for electron laser auto-coupling mirrors, X-ray and UV synchrotron beam line optics. Any grazing incidence optics, laser gyro resonators and domes or radomes may be fabricated, according to the teachings hereof.

These and other objects, features and advantages of the present invention will become more apparent in light of the following detailed description of a best mode embodiment thereof, as illustrated in the accompanying drawing.

BRIEF DESCRIPTION OF THE DRAWING

The drawing, not drawn to scale, includes.

DETAILED DESCRIPTION OF THE INVENTION

Figure 1:
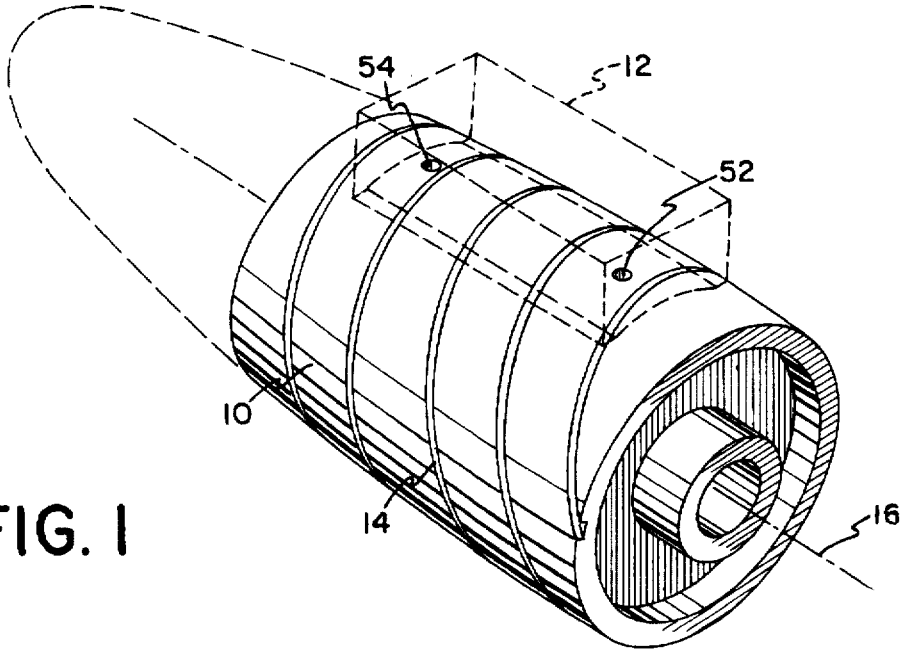
FIG. 1 shows a barrel-shaped tool, according to the present invention.

FIG. 1 shows an embodiment 10 of a barrel-shaped tool, according to the present invention, for form-grinding a grazing incidence optic, such as a mirror 12 shown in phantom in FIG. 1. The shape of the barrel-shaped tool 10 of FIG. 1 is pre-selected to conform to the desired shape of the surface of the optic 12. The tool 10 has a cylindrical, barrel-shaped surface, i.e., an aspherical surface having a helical groove 14 cut therein. The taper of the surface of the barrel tool 10 accommodates the desired shape of the optic. The surface of the tool is prepared with a texture suitable for the desired grinding or polishing effect. The helical groove 14 allows for the same amount of tool surface area to pass under the optical surface per rotation of the tool 10 about an axis of rotation 16. The groove also allows slurry to pass between the optical surface and the tool surface.

As mentioned previously, the azimuthal shape of the tool 10 establishes the desired aspheric departure per a selected conic equation.

Figure 2:
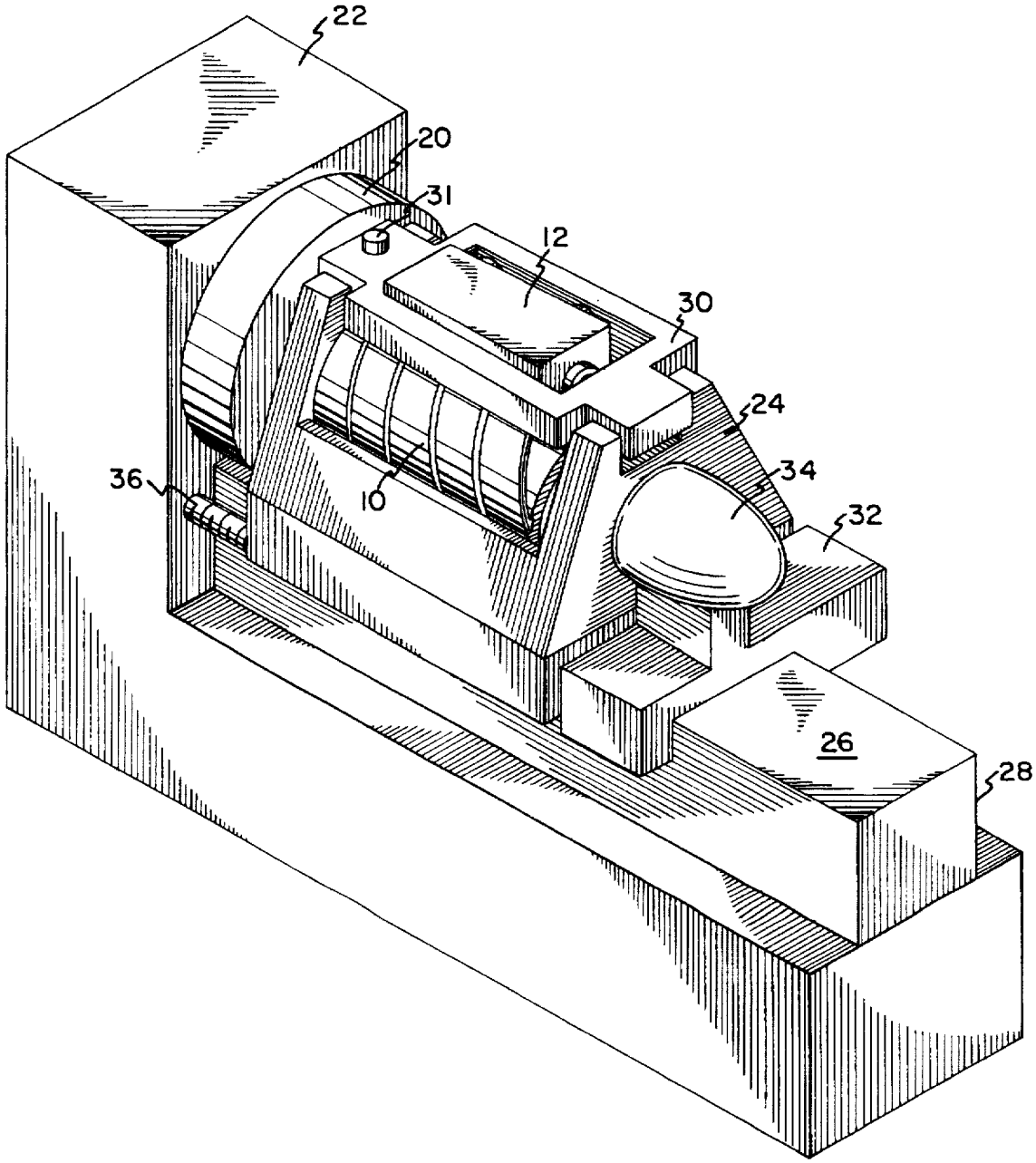
FIG. 2 shows a support fixture, according to the present invention, for an optical component, such as a mirror.

FIG. 2 shows a device in which the barrel-shaped tool 10 of FIG. 1 is mounted so that its axis of rotation is coincident with an axis of rotation of a turning device, or lathe having a spindle 20, driven by a gear and motor (not shown) within or connected to a base 22. A support fixture 24 rests in slidable engagement with a pedestal or lathe ways 28 having a top surface 26. The pedestal 28 is mounted on the base 22.

A frame 30 may be held in position within the support fixture 24 by any convenient method, including tongue-and-groove arrangement, as shown, where one or more of the tongues may be mated to a dowel pin 31 in the support fixture 24, for example. Of course, other methods of securing a frame to an underlying support fixture 24 may be used as well. In fact, the embodiment of an apparatus for fabricating a grazing incidence optic with a barrel-shaped tool, as shown in FIG. 1, may be carried out in any number of different apparatus types, only one example of which is shown in FIG. 2. Thus, it will be understood that numerous other methods of support and support holders for the optic to be worked are well within the spirit and scope of the present invention.

The optical component 12 itself is inserted within the frame 30 and may be held snugly in place by means of teflon pads, for example. The optic is only held snugly and not tightly because there is a need for the optic to float while it is being moved back and forth in a reciprocating motion along the length of the barrel tool.

A device 32 is also mounted in stationary fashion on the top surface 26 of the pedestal 28 and serves the function of holding an idler or bearing device 34 which receives the end of the barrel tool and keeps it dead-centered.

A lead screw 36 may be provided along the longitudinal length of the pedestal 28 for driving the support device 24 in a reciprocating motion so as to cause the optic to move longitudinally back and forth in a similar reciprocating motion on the surface of the barrel tool.

Figure 3:
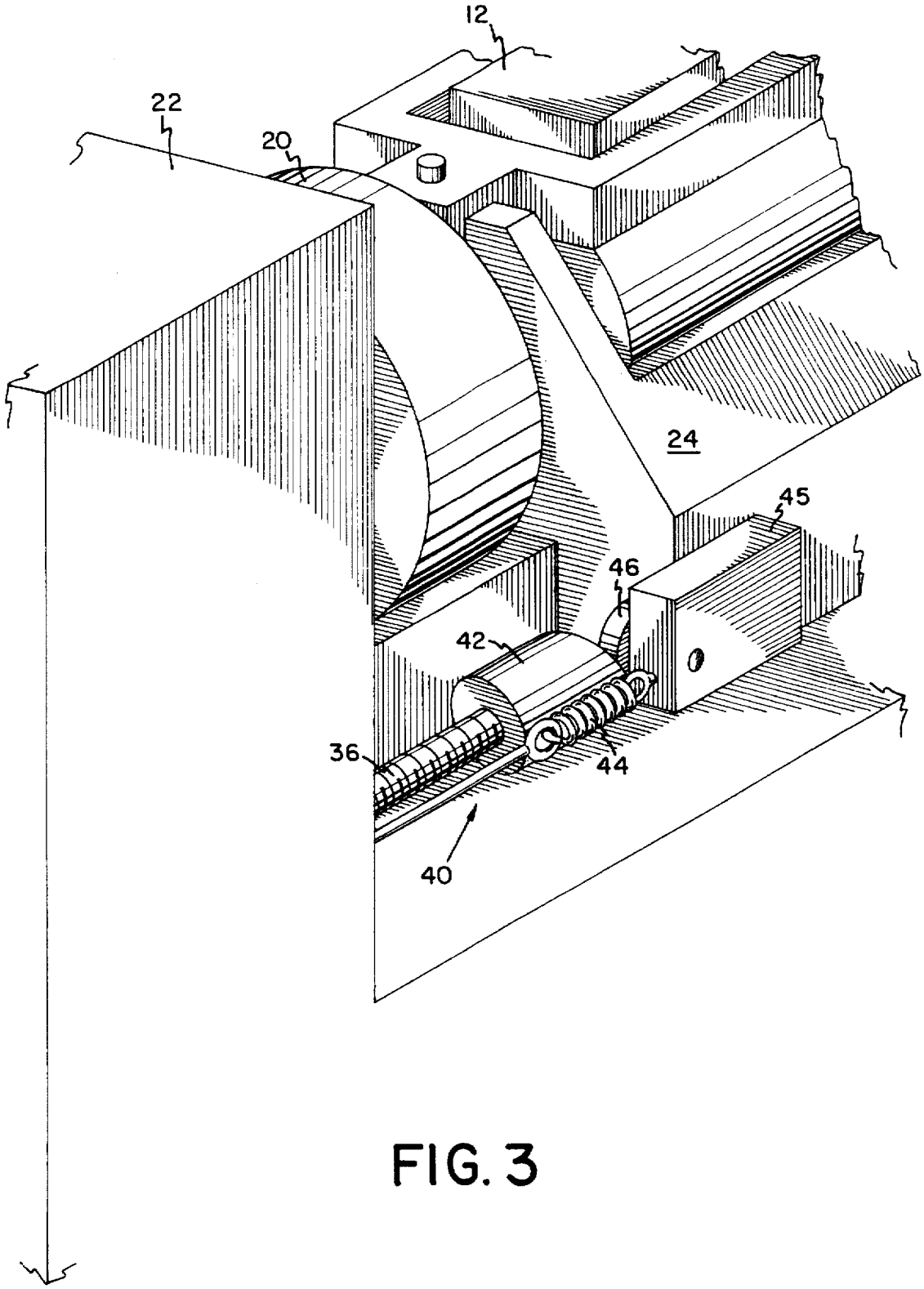
FIG. 3 shows a stroke device, according to the present invention.
Figure 4A:
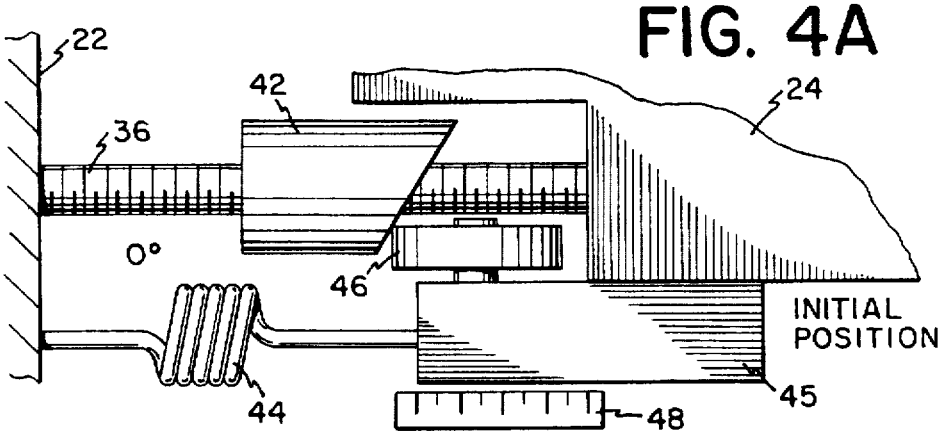
FIGS. 4(*a*)–4(*d*) show a cam, such as shown in FIG. 3, from a top view at various positions of rotation.
Figure 4B:
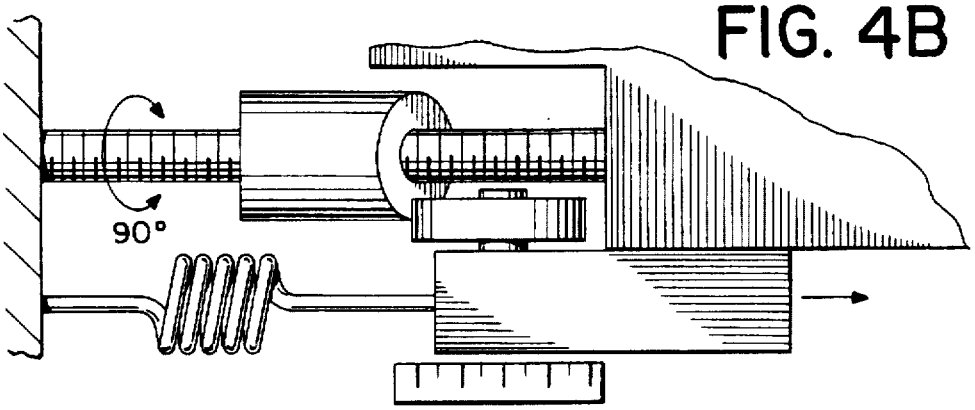
Figure 4C:
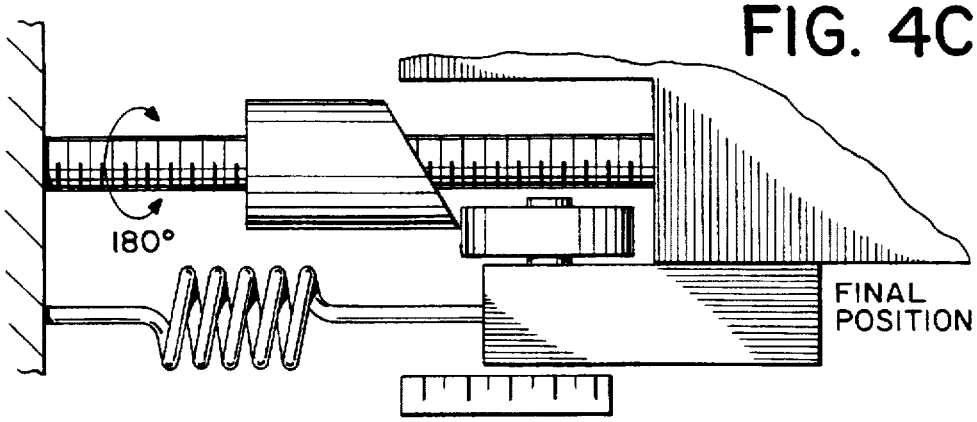
Figure 4D:
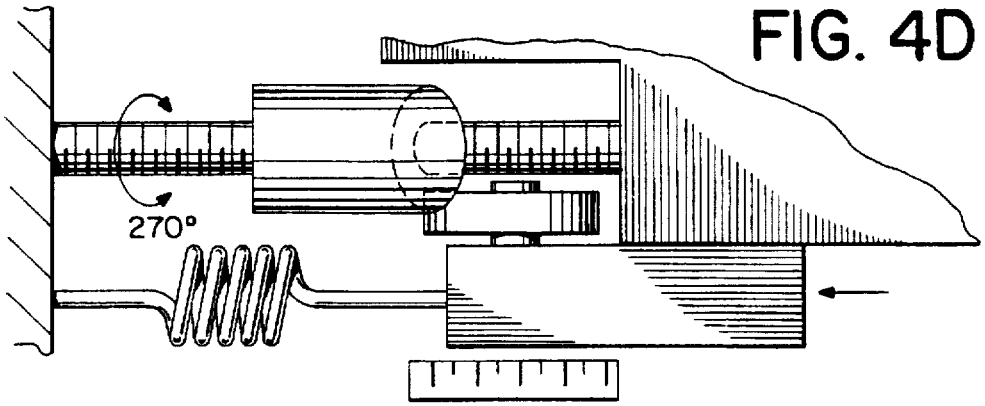

Turning now to FIG. 3, a detailed illustration is provided of a stroke device 40, which may be provided, in accordance with one embodiment of the present invention. The stroke control device 40 is a uniquely-designed combination of a cam 42 and spring 44. The shape of the cam is based on the amount of stroke required and bears against a cam follower roller 46. It achieves stroke by being driven by the lead screw 36. The spring 44 is attached to a block 45 attached to the support fixture 24 and to the base 22. The spring maintains constant contact between the support fixture 24 and cam 42.

FIGS. 4(*a*)–(*d*) show the cam 42 and spring 44 from a top view in various positions of rotation of the cam and makes clear how the cam surface causes the support fixture to move longitudinally as the cam rotates through 360°. A fixed scale 48 illustrates the movement of the fixture. Of course, this represents only one of many ways to move the fixture in a reciprocating motion.

Figure 5:
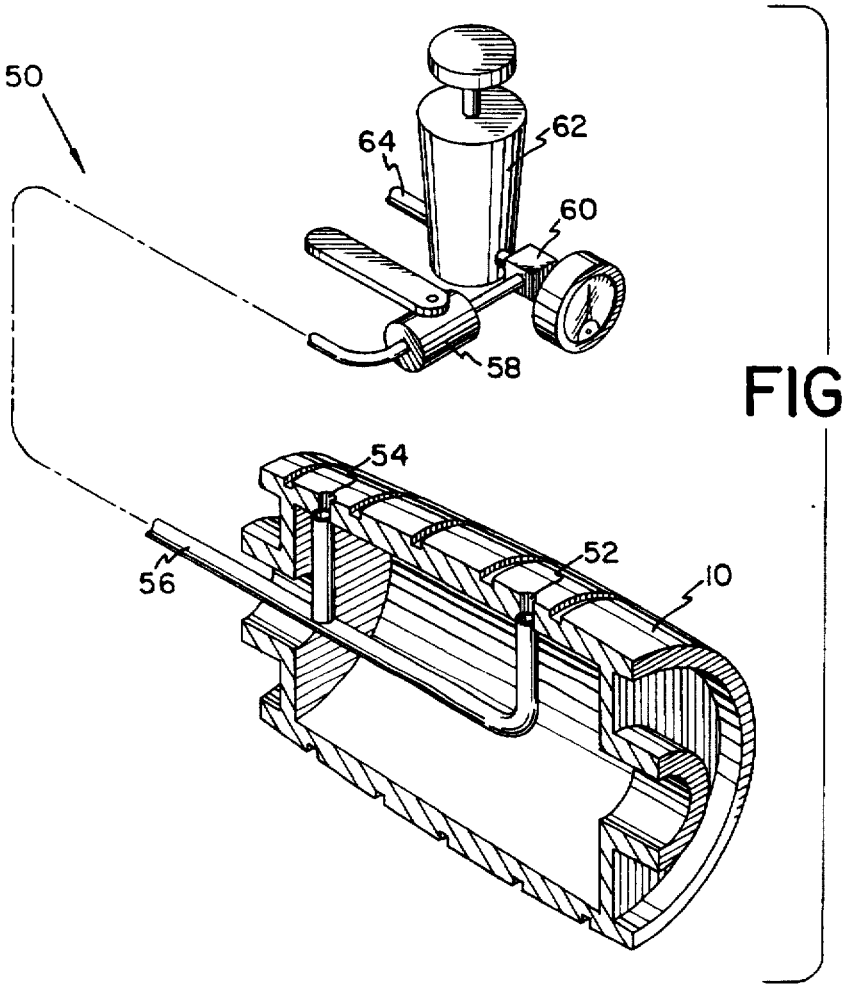
FIG. 5 shows a release device, according to the present invention, for releasing an optical component, such as the mirror of FIG. 2, from the barrel-shaped tool of FIG. 1 after working in the device of FIG. 2, according to the present invention.

Turning now to FIG. 5, a mirror release device 50 is shown. Radial holes 52, 54 are drilled in the surface of the tool 10, through which compressed air is applied by means of a delivery system, including a rotatable tube 56 that is connected to a valve 58, a pressure regulator 60 and a buffer device 62 which receives compressed air from a source 64. It should be noted that tube 56 is disconnected from value 58 during operation but nevertheless rotates with 10. The compressed air is applied at the completion of the tooling operation to separate the optic 12 from the tool 10. This is required due to suction caused by the close fit of the optic to the tool.

It has been found that profilometry and interferometry may be used to verify the accuracy of the grazing incidence of the optic produced by the method and apparatus of the present invention.

Although the invention has been shown and described with respect to a particular embodiment thereof, it should be understood by those skilled in the art that the foregoing and various other changes, omissions and additions in the form and detail thereof may be made therein without departing from the spirit and scope of the invention. Thus, the present invention is deemed limited only by the claims hereof and the reasonable interpretation thereof.

What is claimed is:

1. A method of fabricating a grazing incidence optical component, comprising the steps of:

rotating a grinding tool having a grinding surface about a fixed longitudinal axis of rotation;

placing the optical component against the grinding surface;

moving the optical component with a reciprocating motion; and forcing air between the surface of the optical component and the grinding surface when the optical component is to be released from the grinding surface.

2. Apparatus for fabricating a grazing incidence optical component, comprising:

a grinding tool having a working surface and a longitudinal axis of rotation, and a plurality of passages extending from the work surface into the interior of the tool for permitting air to flow from inside the tool to the working surface;

first mounting means for mounting the tool, said first mounting means allowing the tool to rotate about its longitudinal axis of rotation;

second mounting means for mounting the optical component against the working surface of the tool, said second mounting means allowing the optical component to move in a direction parallel to the longitudinal axis of the tool;

rotation means for rotating the tool about its longitudinal axis;

reciprocating means for causing the second mounting means to move in a reciprocating motion in the direction parallel to the longitudinal axis of rotation of the tool, whereby the optical component is reciprocated along a selected length of the working surface of the tool; and an air delivery system for forcing air into the passages for separating the optical component from the tool.

3. The apparatus of claim 2, wherein the tool comprises a tapered barrel-shaped tool having a helical groove in the surface thereof.

4. The apparatus of claim 2, wherein the means first mounting comprises:

a base for mounting one end of the tool;

a pedestal on the base; and an idler fixedly mounted on the pedestal for mounting another end of the tool.

5. The apparatus of claim 2, wherein the second mounting means comprises:

a base;

a pedestal on the base;

a support fixture for slidable engagement with the pedestal; and a frame in mating engagement with the support fixture for mounting the optical component.

6. The apparatus of claim 5, further comprising means for holding the optical component in a selected position within the frame.

7. The apparatus of claim 2, wherein the reciprocating means comprises:

a lead screw adapted to be rotated;

a cam attached to the lead screw, the cam having a cam surface; and spring means, having one end attached to the first mounting means and having an opposite end attached to the second mounting means for keeping the cam surface in contact with the second mounting means.

8. The apparatus of claim 2, wherein the tool is a grinding tool.

9. The apparatus of claim 2, wherein the tool is a polishing tool.

10. Apparatus for fabricating a grazing incidence optical component, comprising:

a grinding tool having a working surface, a longitudinal axis and air passages therein, said tool being rotatable about its longitudinal axis;

means for mounting the optical component against the working surface of the tool, said mounting means allowing the optical component to move in a direction parallel to the longitudinal axis of the tool;

rotation means for rotating the tool about its longitudinal axis;

reciprocating means for causing the mounting means to move in a reciprocating motion in the direction parallel to the longitudinal axis of rotation of the tool, whereby the optical component is reciprocated along a selected length of the working surface of the tool; and means for forcing air between the working surface of the tool and the optical component when the optical component is to be separated from the tool.

11. The apparatus of claim 10, wherein the tool has at least one helical groove on its working surface.

12. The apparatus of claim 10, wherein the reciprocating means comprises:

a lead screw adapted to be rotated;

a cam attached to the lead screw, the cam having a cam surface; and means for biasing the mounting means against the cam surface.

13. A grinding tool for fabricating a grazing incidence optical component, comprising:

a tapered, barrel-shaped body having a working surface for placement against the optical component and an internal hollow cavity;

a plurality of air passages extending from the working surface to the internal hollow cavity;

an air delivery system for forcing air into the air passages to the working surface for separating the optical component from the tool; and at least one helical groove on the working surface, not intersecting said air passages.

* * * * *